US012618397B2

(12) United States Patent
Klassen

(10) Patent No.: US 12,618,397 B2
(45) Date of Patent: May 5, 2026

(54) PIPE DIVERTER VALVE HOUSING FOR A THICK MATTER PUMP AND THICK MATTER PUMP

(71) Applicant: Schwing GmbH, Herne (DE)

(72) Inventor: Waldemar Klassen, Herne (DE)

(73) Assignee: Schwing GmbH, Herne (DE)

( * ) Notice: Subject to any disclaimer, the term of this patent is extended or adjusted under 35 U.S.C. 154(b) by 0 days.

(21) Appl. No.: 18/866,814

(22) PCT Filed: May 12, 2023

(86) PCT No.: PCT/EP2023/062767
§ 371 (c)(1),
(2) Date: Nov. 18, 2024

(87) PCT Pub. No.: WO2023/222544
PCT Pub. Date: Nov. 23, 2023

(65) Prior Publication Data

US 2025/0334107 A1 Oct. 30, 2025

(30) Foreign Application Priority Data

May 18, 2022 (DE) ..... 10 2022 112 508.4

(51) Int. Cl.
*F04B 7/00* (2006.01)
*F04B 15/02* (2006.01)
*F04B 53/16* (2006.01)

(52) U.S. Cl.
CPC ..... *F04B 7/0034* (2013.01); *F04B 15/02* (2013.01); *F04B 53/16* (2013.01)

(58) Field of Classification Search
CPC .... F04B 7/0026; F04B 7/0034; F04B 7/0042; F04B 7/0046; F04B 7/0049; F04B 15/02;
(Continued)

(56) References Cited

U.S. PATENT DOCUMENTS 3,398,693 A * 8/1968 Schumann ..... F04B 9/1178 280/43.23
3,726,614 A * 4/1973 Schellenberg ..... F04B 7/0034 417/900

(Continued)

FOREIGN PATENT DOCUMENTS

DE 1803819 C3 6/1975
DE 197 31 335 A1 3/1998

(Continued)

OTHER PUBLICATIONS

Search report issued in DE 10 2022 112 508.4, dated Mar. 21, 2023 (No English Translation Available).

(Continued)

*Primary Examiner* — Loren C Edwards
(74) *Attorney, Agent, or Firm* — Faegre Drinker Biddle & Reath LLP

(57) ABSTRACT

An apparatus includes a pipe diverter valve housing and a pipe diverter valve. The pipe diverter valve housing includes a fixed housing part with inlet openings and a detachable housing part with an outlet opening. The detachable housing part is detachable from the fixed housing part, and the detachable housing part and the fixed housing part are pivotably connected to one another via a joint with a first pivot axis. The pipe diverter valve is mounted in the pipe diverter valve housing so as to be pivotable about a second pivot axis in front of the inlet openings and arranged to convey thick matter to the outlet opening of the pipe diverter valve housing.

8 Claims, 5 Drawing Sheets

Figure 3:
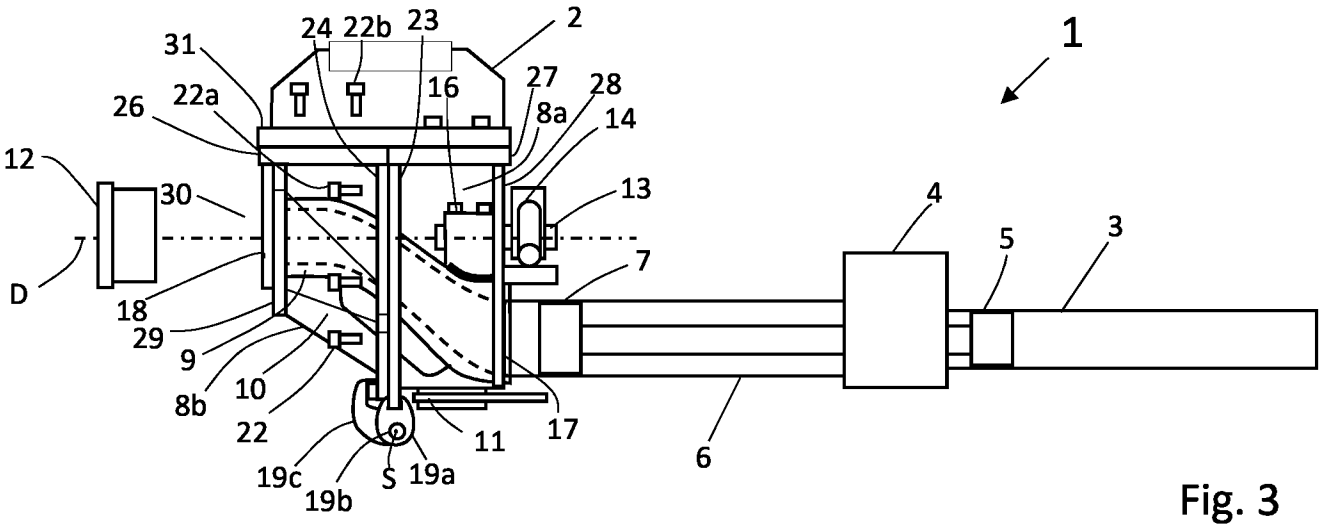

(58) Field of Classification Search
CPC ..... F04B 15/023; F04B 53/16; F04B 11/005; Y10S 417/90
See application file for complete search history.

(56) References Cited

U.S. PATENT DOCUMENTS

| | | | |
|---|---|---|---|
| 5,332,366 | A | 7/1994 | Anderson |
| 5,857,490 | A | 1/1999 | Kao |
| 2003/0215344 | A1 | 11/2003 | Condon et al. |
| 2004/0261869 | A1 | 12/2004 | Hurr |

FOREIGN PATENT DOCUMENTS

| | | | |
|---|---|---|---|
| JP | H05-10252 | A | 1/1993 |
| WO | 8910486 | A1 | 11/1989 |
| WO | 03042535 | A1 | 5/2023 |

OTHER PUBLICATIONS

International Search Report and Written Opinion issued in International application No. PCT/EP2023/062767 mailed Jul. 21, 2023 (English Translation).

* cited by examiner

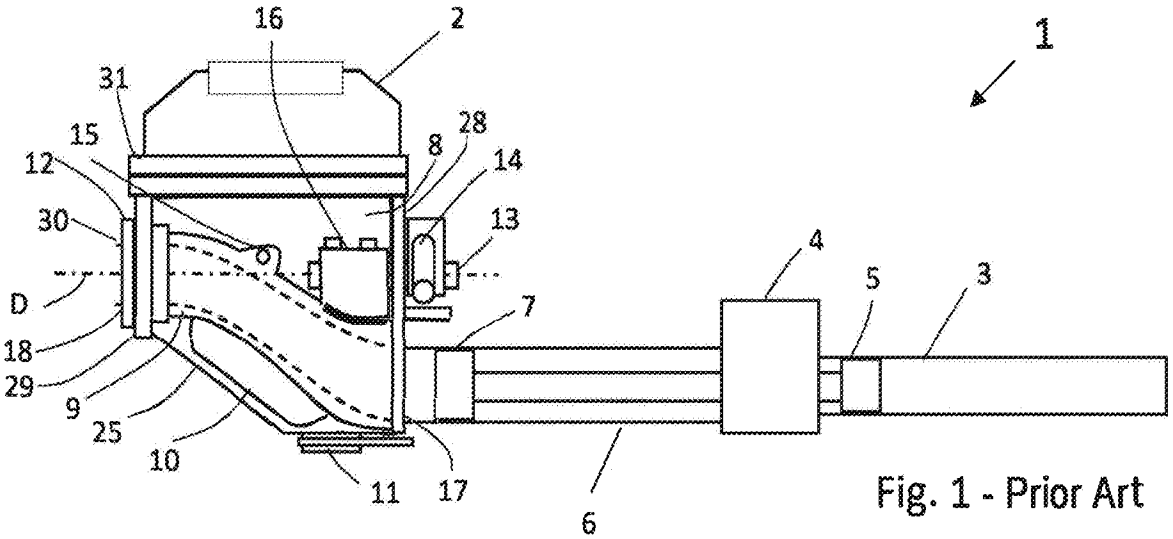
Fig. 1 - Prior Art
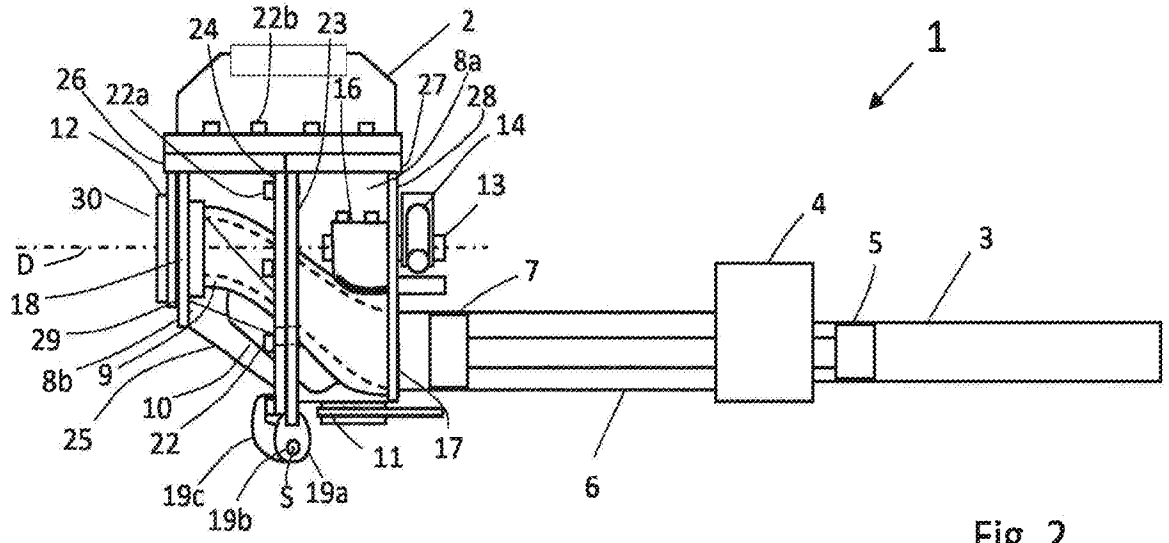
Fig. 2

PIPE DIVERTER VALVE HOUSING FOR A THICK MATTER PUMP AND THICK MATTER PUMP

CROSS-REFERENCE TO RELATED APPLICATION

This application is a U.S. national stage application of International Application No. PCT/EP2023/062767, filed May 12, 2023, which claims priority to German Patent Application No. DE 10 2022 112 508.4, filed May 18, 2022, both of which are herein incorporated by reference in their entireties.

The invention relates to a pipe diverter valve housing for accommodating a pipe diverter valve of a two-cylinder thick-matter pump, wherein the pipe diverter valve is mounted in the pipe diverter valve housing so as to be pivotable about a pivot axis in front of two inlet openings of the pipe diverter valve housing directed towards conveying cylinders and is designed to guide thick matter to an outlet opening of the pipe diverter valve housing, and to a two-cylinder thick matter pump with such a pipe diverter valve housing.

Two-cylinder thick matter pumps have long been known in the state of the art for industrial applications, e.g. for pumping biowaste, sewage sludge and the like, but also, for example, as concrete pumps for pumping concrete on construction sites.

In these thick matter pumps, the thick matter, i.e. the material to be conveyed, is alternately sucked in by two conveying cylinders driven by hydraulic cylinders, which open into a pipe diverter valve housing, and conveyed into a conveying line by means of a pipe diverter valve arranged in the pipe diverter valve housing.

Due to their shape, so-called S-pipes, rock valves or C-pipes are used as pipe diverter valves for these thick matter pumps.

The pipe diverter valves themselves, but also the seals of the pipe diverter valves to the inlets and outlets in the pipe diverter valve housing are subject to heavy wear and must be regularly maintained and replaced if necessary. It is known in particular from pipe diverter valves designed as S-pipes that they can only be removed from the pipe diverter valve housing with great effort for repair, maintenance or replacement because the S-pipe has to be lifted upwards out of the pipe diverter valve housing. A prior art S-pipe installed in a pipe diverter valve housing is shown in FIG. 1, for example. To remove the S-pipe, the feed unit arranged above the pipe diverter valve is first removed. The drive shaft and the bearing on the output side of the S-pipe are then removed. The S-pipe can then be lifted upwards out of the pipe diverter valve housing, for example suspended from a lifting eye, with a tilting movement to pull the outlet out of the outlet opening during lifting.

It is therefore the task of the invention to provide a pipe diverter valve housing which at least partially solves the above-mentioned problems when removing or maintaining the pipe diverter valve of a two-cylinder thick matter pump.

This task is solved by a pipe diverter valve housing for accommodating a pipe diverter valve of a two-cylinder thick matter pump and by a two-cylinder thick matter pump.

Because the pipe diverter valve housing comprises a fixed housing part with the inlet openings and a housing part with the outlet opening that can be detached from the fixed housing part, the pipe diverter valve can be very easily removed, i.e. in particular pulled out, for maintenance and repair purposes after the two housing parts have been separated from each other. Due to this division of the housing, it is also advantageously no longer necessary to remove the feed unit arranged above the pipe housing in order to dismantle the pipe diverter valve. By using a joint that connects the two halves of the housing, the pipe diverter valve housing can be opened by pivoting the detachable half of the housing without having to remove the detachable half of the housing, for example with the aid of a load-lifting device.

Advantageously, the fixed housing part and the detachable housing part of the pipe diverter valve housing each have flat separating surfaces via which the housing parts are connected to each other. Due to the flat separating surfaces, which in particular have no edges or strong bends, the two housing halves of the pipe diverter valve housing can be easily sealed against each other, for example by using a simple, also flat seal.

According to an advantageous embodiment of the invention, the flat separating surfaces of the housing parts of the pipe diverter valve housing preferably run perpendicular to the pivot axis of the pipe diverter valve. This has the advantage that after removal of the detachable housing half, the pipe diverter valve can be pulled out of the fixed housing part in the direction of the pivot axis.

Advantageously, the flat separating surfaces of the housing parts are formed by flange collars. This measure allows the two housing parts to be connected to each other very easily and tightly via the flange collars, for example using screw connections.

According to an advantageous embodiment, the detachable housing part of the pipe diverter valve housing has an inclined lower plate below the pipe diverter valve. This has the advantage that after removing the detachable housing part, the inclined lower plate is no longer in the way when removing the pipe diverter valve.

Advantageously, the detachable housing part and the fixed housing part are pivotably connected to each other via a joint with a pivot axis. By using a joint that connects the two halves of the housing, the pipe diverter valve housing can be opened by swivelling the detachable half of the housing without having to remove the detachable half of the housing, for example with the aid of a load-lifting device.

According to an advantageous embodiment, the joint that pivotably connects the housing parts is arranged on the underside of the pipe diverter valve housing. This means that the detachable housing part can simply be swung downwards. In particular, this arrangement of the joint means that a feed unit arranged above the pipe diverter valve housing can remain there and the pipe diverter valve is easily accessible after swivelling down.

Advantageously, the pivot axis of the joint is offset in the direction of the fixed housing part. The offset arrangement of the pivot axis of the joint in relation to the detachable housing part ensures that the top of the detachable housing part, which is arranged directly below the feed unit, moves directly away from the feed unit when it is swivelled down.

Advantageously, the fixed housing part has a cleaning opening on the underside. As a result of this measure, the cleaning opening is located in the lowest area of the pipe diverter valve housing and during cleaning work, residues of thick matter can simply be flushed out through the cleaning opening without the residues of the thick matter remaining in the lower area of the pipe diverter valve housing.

Advantageously, the pipe diverter valve is an S-pipe, which is particularly suitable for conveying a variety of different thick matter, especially biomass.

A further object of the invention is a two-cylinder thick matter pump, described above and in more detail below, with a pipe diverter valve housing described above and in more detail below, wherein the pipe diverter valve of the two-cylinder thick matter pump is mounted in the pipe diverter valve housing so as to be pivotable about a pivot axis in front of two inlet openings of the pipe diverter valve housing directed towards conveying cylinders of the two-cylinder thick matter pump and is designed to convey thick matter to an outlet opening of the pipe diverter valve housing.

Figure 4:
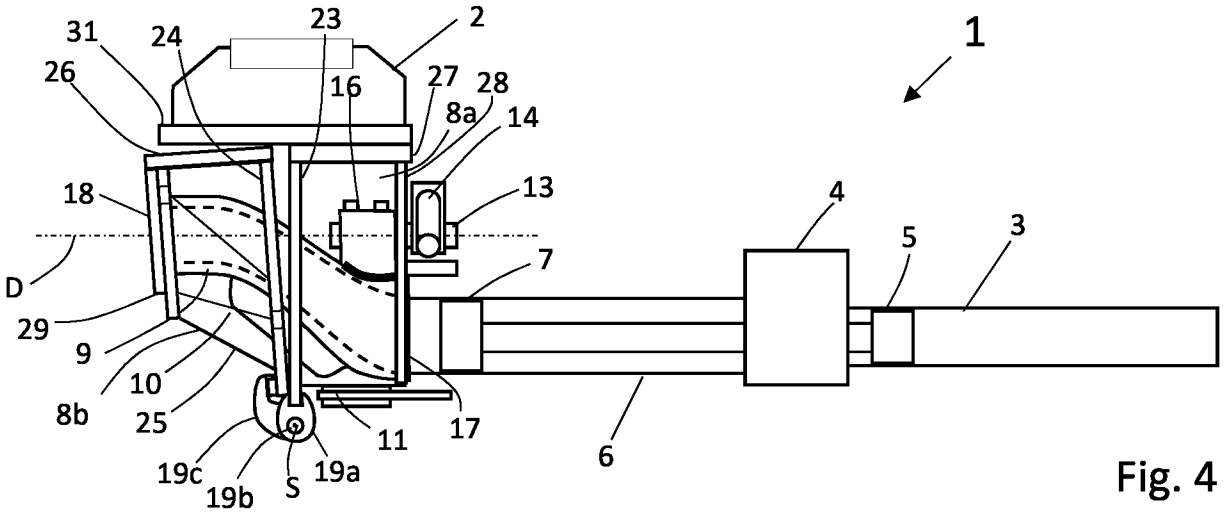
Figure 5:
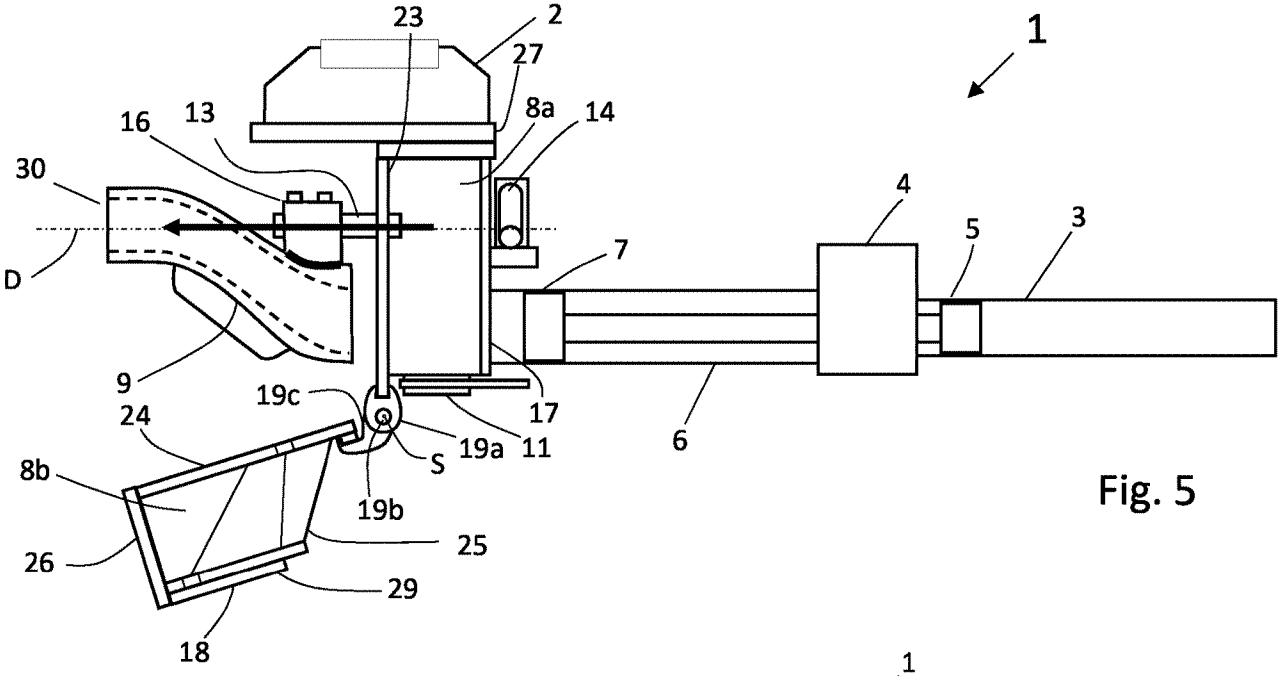
Figure 6:
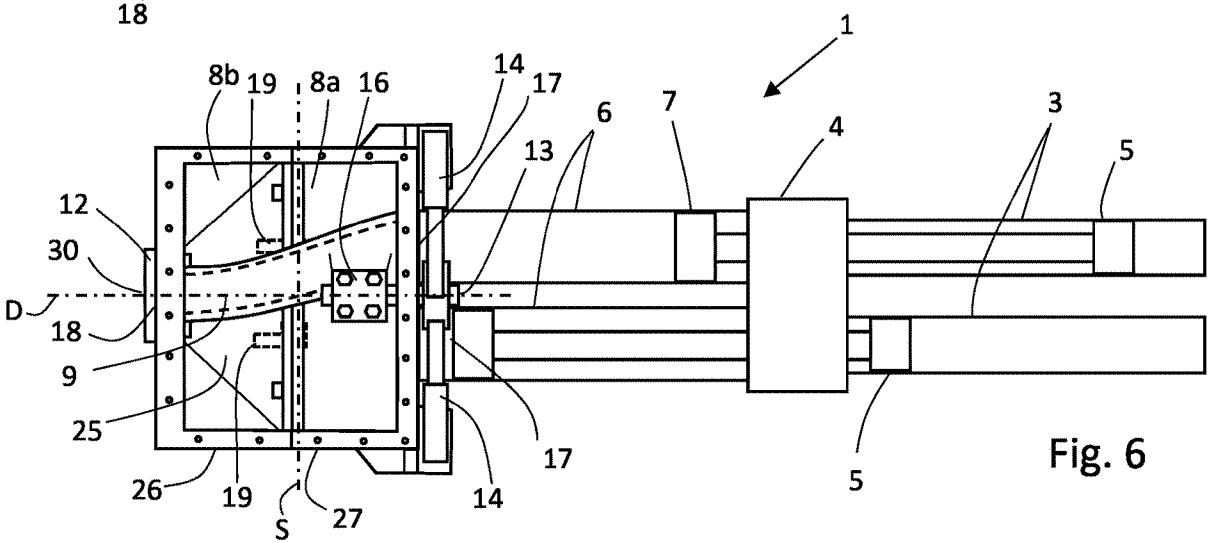
Figure 9:
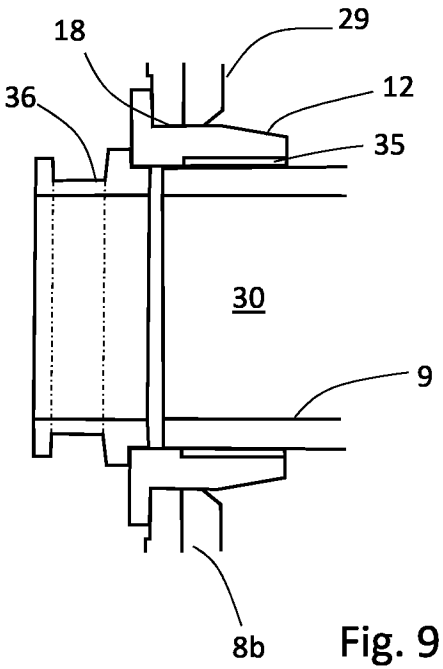
Figure 7:
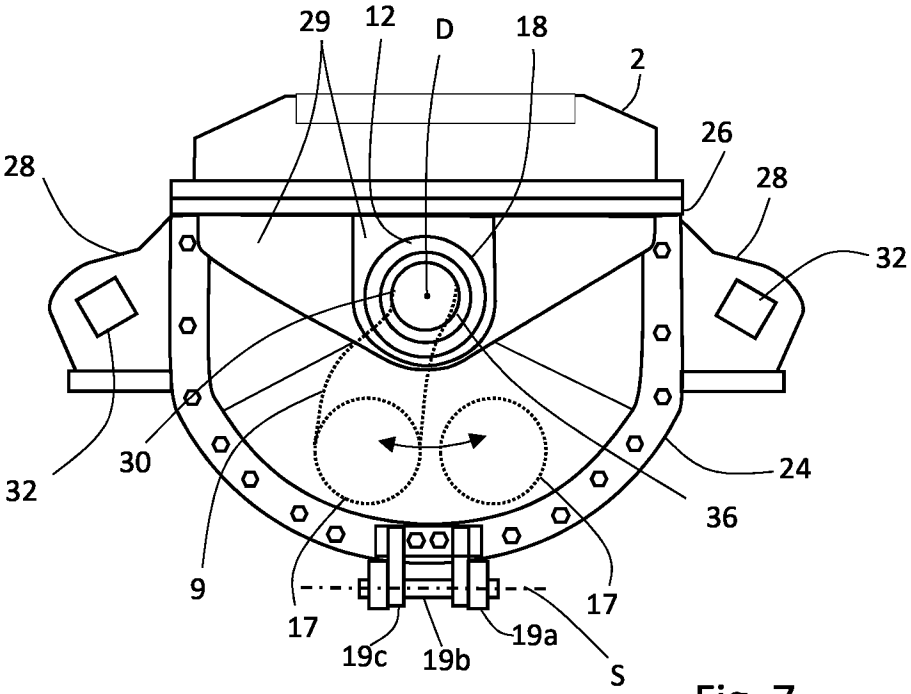
Figure 8:
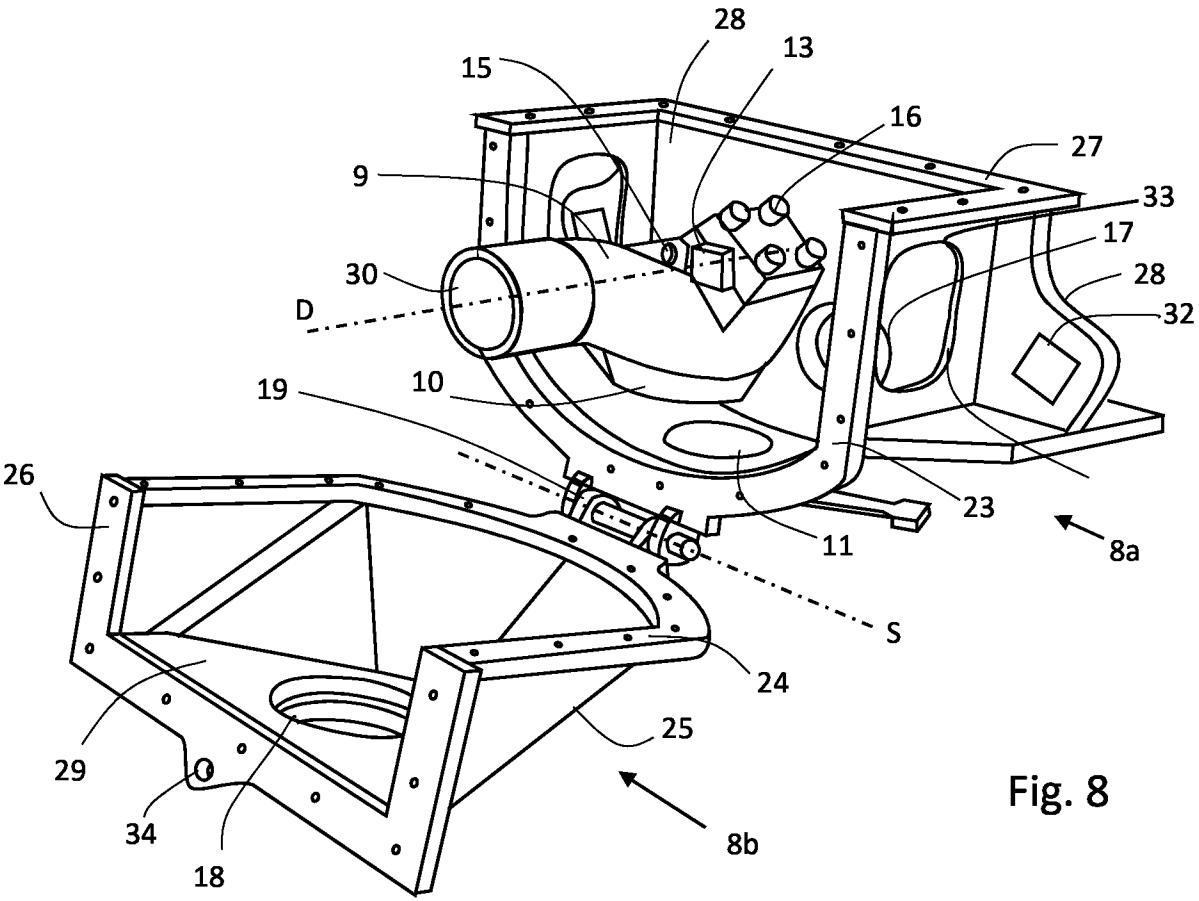

Further features, details and advantages of the invention will become apparent from the following description and from the drawings, which show embodiments of the invention. Corresponding objects or elements are provided with the same reference signs in all figures. It shows:

FIG. 1 Thick matter pump with a pipe diverter valve housing according to the state of the art FIG. 2 Side view of a thick matter pump with a pipe diverter valve housing according to the invention in the closed state FIG. 3 Side view of a thick matter pump with a pipe diverter valve housing according to the invention during a first step of the opening process FIG. 4 Side view of a thick matter pump with a pipe diverter valve housing according to the invention during a second step of the opening process FIG. 5 Side view of a thick matter pump with a pipe diverter valve housing according to the invention in the open state FIG. 6 Top view of a thick matter pump with a pipe diverter valve housing according to the invention FIG. 7 Front view of a thick matter pump with a pipe diverter valve housing according to the invention FIG. 8 Spatial view of the pipe diverter valve housing according to the invention in the open state FIG. 9 Sectional view of the outlet area of the pipe diverter valve housing according to the invention As already explained above, FIG. 1 shows a side view of a pipe diverter valve housing 8 of a two-cylinder thick matter pump 1 according to the state of the art. The pipe diverter valve housing 8 accommodates a pipe diverter valve 9 designed as an S-pipe. A feed unit 2 is arranged above the pipe diverter valve housing 8, through which the thick matter to be pumped enters the pipe diverter valve housing 8. The feed unit 2 can be, for example, a feed hopper with an agitator, as is common in concrete pumps, or a screw conveyor, as is common in biomass pumps, for example, which presses the thick matter to be conveyed into the pipe diverter valve housing 8 from above under pressure. To remove the pipe diverter valve 9, the feed unit 2 must first be dismantled and the guide bushing 12 on the outlet side and, if necessary, the drive shaft 13 removed. Only then can the pipe diverter valve 9 be lifted upwards out of the pipe diverter valve housing 8, for example by the lifting eye 15. In doing so, it must still be tilted slightly in the pipe diverter valve housing 8 in order to first pull the outlet 30 out of the outlet opening 18 of the pipe diverter valve housing 8. The removal of a pipe diverter valve 8 from a pipe diverter valve housing 8 according to the prior art is time-consuming and involves a great risk of injury.

FIGS. 2 to 8 show a two-cylinder thick matter pump 1 according to the invention, in which a pipe diverter valve 9 is mounted in a pipe diverter valve housing 8 pivotably about a pivot axis D in front of two inlet openings 17 of the pipe diverter valve housing 8 directed towards conveying cylinders 6 and is designed to convey thick matter to an outlet opening 18 of the pipe diverter valve housing 8. The pipe diverter valve housing 8 comprises a fixed housing part 8*a* with the inlet openings 17 and a housing part 8*b* with the outlet opening 18, which can be detached from the fixed housing part 8*a*.

For a better illustration of the invention, the side walls of the pipe diverter valve housing 8 are shown quasi-transparent in the side views of FIGS. 2 to 5 in order to allow a view into the interior of the pipe diverter valve housing 8.

The two-cylinder thick matter pump 1 also has two hydraulic cylinders 3 with pistons arranged in parallel, which drive the conveying pistons 7 of the conveying cylinders via piston rods. The two conveying cylinders 6 work in a push-pull action, i.e. while one conveying cylinder 6 draws thick matter from the pipe diverter valve housing 8 through the inlet opening 17, the other conveying cylinder 6 presses the drawn-in thick matter through the inlet opening 17 and the pipe diverter valve 9 to the outlet of the pipe diverter valve 9. As soon as the conveying piston 7 has arrived at the inlet opening 17 of the pipe diverter valve housing 8*b*, the pipe diverter valve 9 swivels around the pivot axis D to the other inlet opening 17 so that the other conveying cylinder 6 starts conveying. A water box 4 is arranged between the hydraulic cylinders 3 and the conveying cylinders 6, which contains water for the rear cooling and lubrication of the conveying pistons 6.

The pipe diverter valve 9 is driven in a pivoting manner, for example, by one or two hydraulic or plunger cylinders 14 via the drive shaft 13, which is screwed to the pipe diverter valve 9, for example, via the coupling 16. In this exemplary illustration, the hydraulic or plunger cylinders 14 are attached to the rear wall 28 of the fixed housing part 8*b* by means of the mounts 32. Other drive options, for example an electric drive or other hydraulic drive types 14 are possible. The feed unit 2 is connected to the fixed housing part 8*a* and the detachable housing part 8*b* of the pipe diverter valve housing 8, for example, by means of the flange collar 31 and screw connections 22*b*. A flange collar 27 is arranged in the upper area of the fixed pipe diverter valve housing 8*a* and a flange collar 26 is arranged in the upper area of the detachable pipe diverter valve housing 8*b*, with which these are screwed to a flange collar 31 of the feed unit 2 with the screw connection 22*b*.

The pipe diverter valve 9 is rotatably mounted in the area of its outlet 30 by means of a guide bushing 12 within the outlet opening 18 of the detachable housing part 8*b* of the pipe diverter valve housing 8, so that the pipe diverter valve 9 can be pivoted by the drive 14 about the pivot axis D in front of the inlet openings 17.

The fixed housing part 8*a* and the detachable housing part 8*b* of the pipe diverter valve housing 8 each have flat separating surfaces 23, 24, via which the housing parts 8*a*, 8*b* are connected to each other. In this exemplary embodiment, these separating surfaces 23, 24 are designed as flange collars 23, 24, which tightly connect the two housing parts 8*a*, 8*b* of the pipe diverter valve housing 8 to each other via screw connections 22*a*. A simple rubber seal or other sealing material can be arranged between the two flat flange collars 23, 24, for example, in order to improve the seal.

The flat separating surfaces 23, 24 of the housing parts 8*a*, 8*b* of the pipe diverter valve housing 8, which are designed as flange collars 23, 24 in this example, run perpendicular to the pivot axis D of the pipe diverter valve 9. However, the separating surfaces 23, 24 could also be tilted slightly towards the pivot axis D of the pipe diverter valve 9. The detachable housing part 8*b* of the pipe diverter valve housing 8 has an inclined lower plate 25 below the pipe diverter valve 9. As can be seen in connection with the front view of FIG. 4, the lower plate 25 is more or less a conical section, which ensures that the distance between the underside of the S-pipe 9 or the scraper 10 and this lower plate 25 remains almost constant and small in order to avoid thick matter deposits in this area. Any thick matter remaining in the pipe diverter valve housing 8 at the end of the thick matter conveying process can simply be flushed out via the cleaning opening 11, which is located on the underside of the fixed housing part 8*b*.

The detachable housing part 8*b* and the fixed housing part 8*a* are connected to each other via a pivot joint 19 so that they can swivel about the pivot axis S. The pivot joint 19 pivotably connecting the housing parts 8*a* and 8*b* to each other is arranged on the underside of the pipe diverter valve housing 8 and the pivot axis S of the pivot joint 19 is slightly offset in the direction of the fixed housing part 8*b*, as will be explained in more detail in connection with FIGS. 5 to 7.

In this exemplary embodiment, the pivot joint 19 consists of two parallel joint legs 19*a*, each of which is firmly connected to the fixed housing part 8*a* via the flange collar 23, and two parallel joint legs 19*b*, each of which is firmly connected to the detachable housing part 8*b* via the flange collar 24. A bolt 19*c* forming the pivot axis S connects the joint legs 19*a* and 19*b* to each other so that the housing parts 8*a* and 8*b* are connected to each other in a swivel-moving manner.

FIG. 3 shows a side view of a thick matter pump 1 with a pipe diverter valve housing 8 according to the invention during a first step of the opening process of the detachable housing part 8*b*. First, the guide bushing 12 is removed from the outlet opening 18 of the front plate 29. This results in a free area around the outlet 30 of the pipe diverter valve 9. In addition, the drive shaft 13 of the pipe diverter valve 9 is detached from the drive 14 and the flange screw connection 22*b* of the detachable housing part 8*b* with the flange collar 31 of the feed unit 2 is removed. The feed unit 2 is otherwise not dismantled any further and remains connected to the fixed housing part 8*b* via the screw connection 22*b*.

In the next step, as shown in FIG. 4, the detachable housing part 8*b* can be swivelled down about the pivot axis S. Due to the arrangement of the pivot axis S and the dismantled guide bushing 12 of the pipe diverter valve 9, the outlet opening 18 does not collide with the outlet 30 of the pipe diverter valve 9 and also not with the flange collar 31 of the feed unit 2. Due to the fact that the pivot axis S is slightly offset in the direction of the fixed housing part 8*a*, the flange collar 26 simply detaches from the flange collar 31 of the feed unit 2 when the housing part 8*a* is swivelled down, so that a seal inserted between the flange collars 26 and 31 is not damaged by the opening process.

FIG. 5 shows a side view of the open pipe diverter valve housing 8 of the thick matter pump 1, in which the detachable housing part 8*b* of the pipe diverter valve housing 8 is swivelled downwards by approximately 110 degrees. Stops on the joint legs 19*b* could also prevent the detachable housing part 8*b* from being swivelled further downwards. Without these stops, the detachable housing part 8*b* could also simply be swivelled downwards by up to 180 degrees, provided there is sufficient space. The pipe diverter valve 9 can now simply be removed from the fixed housing part 8*a* of the open pipe diverter valve housing 8 in the direction of the arrow. If only the sealing system, for example a cutting ring not shown, which seals the inlet 17 of the pipe diverter valve 9 against the openings of the conveying cylinders 7, needs to be replaced, the pipe diverter valve 9 can also be pulled forward just a little on the drive shaft 13 in order to replace the cutting ring without completely removing the pipe diverter valve 9.

FIG. 8 shows a spatial view of the pipe diverter valve housing 8 according to the invention, in which the detachable housing part 8*b* is swivelled down over the pivot axis S of the joint 19. For better visualisation, the feed unit 2 is not shown here. In this figure, the flat separating surfaces 23, 24 formed by the flange collars 23, 24 are particularly easy to recognise, which enable the housing parts 8*a* and 8*b* to be sealed off from each other particularly easily. FIG. 8 also shows service openings 33 arranged laterally in the fixed housing part 8*a*, which allow lateral access to the inside of the pipe diverter valve housing for simple cleaning and maintenance work without having to open the pipe diverter valve housing 8 completely. The service openings 33 are closed with plates during operation of the thick matter pump 1. FIG. 8 also shows a lifting eye 34 on the upper flange collar 26 of the detachable housing part 8*b*, which makes it easier to fold down the detachable housing part 8*b* using a suitable lifting device.

FIG. 9 shows a sectional view of the outlet opening 18 of the detachable housing part 8*b* of the pipe diverter valve housing 8 with the mounted guide bushing 12 and with the outlet 30 of the pipe diverter valve 9. A sealing package 35 is arranged inside the guide bushing 12, which seals the outlet 30 of the pipe diverter valve 9. On the outlet side, an outlet flange 36 is connected together with the guide bushing 12 to the double-walled front plate 29, to which a conveying line, for example with a shell coupling not shown, is connected. FIG. 9 shows in particular that the outlet 30 of the pipe diverter valve 9 already ends in the area of the front plate 9 and does not protrude beyond it. This is advantageous in that, after disassembly of the guide bushing 12 with the outlet flange 36, the front plate 9 can be swivelled down, as described above, without the outlet opening 18 in the front plate 29 colliding with the outlet 30 of the pipe diverter valve 9. If the outer diameter of the guide bushing 12 were larger, the outlet 30 could also protrude from the front plate 29 without colliding with the outlet opening 18 when the housing part 8*b* is opened.

The depth of the two housing parts 8*a* and 8*b* of the pipe diverter valve housing 8 in the direction of the pivot axis D of the pipe diverter valve 9 is approximately the same and results for the fixed housing part 8*a* from the fact that sufficient space is available in its lower area for the cleaning opening 11. The depth of the detachable housing part 8*b* is based in particular on the inclined lower plate 25, which must be swivelled away as completely as possible with the housing part 8*b* so that the pipe diverter valve 9 can be pulled out of the pipe diverter valve housing 8 in the direction of the pivot axis D without colliding with the lower plate 25.

The S-pipe is reinstalled and the pipe diverter valve housing 8 is closed in the reverse order to the removal process.

The pipe diverter valve housing 8 with the housing parts 8*a* and 8*b* is preferably made of metal as a welded construction or as a cast part.

LIST OF REFERENCE NUMERALS

1 Two-cylinder thick-matter pump
2 Feed unit
3 Hydraulic cylinder
4 Waterbox
5 Piston

6 Conveying cylinder
7 Conveying piston
8 Pipe diverter valve housing
8*a* Fixed housing part of the pipe diverter valve housing
8*b* Detachable housing part of the pipe diverter valve housing
9 Pipe diverter valve (S-pipe)
10 Scraper
11 Cleaning opening
12 Guide bushing
13 Drive shaft
14 Drive cylinder
15 Lifting eye
16 Coupling
17 Inlet opening pipe diverter valve housing
18 Outlet opening pipe diverter valve housing
19 *a,b,c* pivot joint
22 Screw connection
23 Flange collars fixed housing part
24 Flange collars detachable housing part
25 Lower plate
26 Upper flange collar detachable housing part
27 Upper flange collar fixed housing part
28 Rear wall
29 Front wall
30 Outlet pipe diverter valve
31 Flange collar feed unit
32 mounts drive cylinder
33 Service opening
34 Lift eye
35 Sealing package
36 Outlet flange

The invention claimed is:

1. An apparatus comprising:

a pipe diverter valve housing comprising a fixed housing part with inlet openings and a detachable housing part with an outlet opening and an inclined lower plate, wherein the detachable housing part is detachable from the fixed housing part, wherein the detachable housing part and the fixed housing part are pivotably connected to one another via a joint with a first pivot axis; and a pipe diverter valve mounted in the pipe diverter valve housing so as to be pivotable about a second pivot axis in front of the inlet openings and arranged to convey thick matter to the outlet opening of the pipe diverter valve housing, the pipe diverter valve defining an S-pipe, wherein the inclined lower plate of the detachable housing part is positioned below the pipe diverter valve and positioned such that, when the detachable housing part is pivoted away from the fixed housing part, the pipe diverter valve is removable from the pipe diverter valve housing without colliding with the inclined lower plate.

2. The apparatus of claim 1, wherein the fixed housing part and the detachable housing part each have flat separating surfaces via which the fixed housing part and the detachable housing part are connected to one another.

3. The apparatus of claim 2, wherein the flat separating surfaces extend perpendicular to the second pivot axis of the pipe diverter valve.

4. The apparatus of claim 2, wherein the flat separating surfaces are formed by flange collars.

5. The apparatus of claim 1, wherein the joint pivotably connecting the fixed housing part and the detachable housing part to one another is arranged on an underside of the pipe diverter valve housing.

6. The apparatus of claim 1, wherein the first pivot axis of the joint is offset in a direction of the fixed housing part.

7. The apparatus of claim 1, wherein the fixed housing part has a cleaning opening on an underside of the fixed housing part.

8. A two-cylinder thick matter pump with the apparatus of claim 1.

* * * * *